US010427278B2

(12) United States Patent
Su

(10) Patent No.: US 10,427,278 B2
(45) Date of Patent: Oct. 1, 2019

(54) DRIVING TOOL

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 175 days.

(21) Appl. No.: 15/416,029

(22) Filed: Jan. 26, 2017

(65) Prior Publication Data

US 2017/0291288 A1 Oct. 12, 2017

(30) Foreign Application Priority Data

Apr. 7, 2016 (TW) ..... 105110951 A

(51) Int. Cl.
*B25B 23/00* (2006.01)
*B25B 15/00* (2006.01)

(52) U.S. Cl.
CPC ..... *B25B 23/0035* (2013.01); *B25B 15/001* (2013.01)

(58) Field of Classification Search
CPC ..... B25B 23/0035; B25B 15/001
USPC ..... 81/438
See application file for complete search history.

(56) References Cited

U.S. PATENT DOCUMENTS 6,332,382 B1 12/2001 Anderson et al.
6,745,652 B2 6/2004 Chen
8,418,587 B2 4/2013 DeBaker
8,800,407 B2 8/2014 DeBaker
8,973,473 B2 * 3/2015 Su ..... B25B 15/005 81/177.85
9,597,783 B2 * 3/2017 Zhang ..... B25B 15/001
10,022,845 B2 * 7/2018 Neitzell ..... B25B 15/002
10,065,294 B2 9/2018 DeBaker
10,065,295 B2 9/2018 Su
2004/0065176 A1 4/2004 Lin
2013/0340577 A1 * 12/2013 Su ..... B25B 23/0035 81/438

(Continued)

FOREIGN PATENT DOCUMENTS

CN 201115946 Y 9/2008
TW M388993 U 9/2010

(Continued)

*Primary Examiner* — Hadi Shakeri
(74) *Attorney, Agent, or Firm* — Alan D. Kamrath; Mayer & Williams PC

(57) ABSTRACT

A driving tool includes a coupling component defining a compartment and a driving component received by the compartment. The compartment includes a first receiving section and a second receiving section. The driving component includes a first driving body portion, a second driving body portion, and a connecting portion. The connecting portion is inserted through the first receiving section and is fixedly disposed in the second receiving section. The connecting portion and the second receiving section are forced into a tight interference fit with each other. The second driving body portion includes a length inserted and disposed in the first receiving section. The first and second driving body portions are made to have a first hardness, and the connecting portion is made to have a second hardness respectively. The second hardness is less than the first hardness.

11 Claims, 4 Drawing Sheets

(56) References Cited

U.S. PATENT DOCUMENTS

2015/0217435 A1* 8/2015 Vasudeva ..... B25B 23/0035
81/438

FOREIGN PATENT DOCUMENTS

| | | | |
|---|---|---|---|
| TW | M389617 | U | 10/2010 |
| TW | M389617 | U1 | 10/2010 |
| TW | M392716 | U | 11/2010 |
| TW | M406492 | U | 7/2011 |
| TW | M415028 | U | 11/2011 |
| TW | M415031 | U | 11/2011 |
| TW | M458282 | U | 8/2013 |
| TW | M478574 | U | 5/2014 |
| TW | M507333 | U | 8/2015 |
| WO | WO2014002862 | A1 | 1/2014 |

* cited by examiner

DRIVING TOOL

BACKGROUND OF THE INVENTION

1. Field of the Invention

The present invention relates to a driving tool and, particularly, to a driving tool including a driver and a socket coupled to the driver.

2. Description of the Related Art

A bit is a one piece driving tool that is made from a single material and that includes a connecting end for connecting with a tool and a driving end for engaging with an object to be driven. Furthermore, rather than using a long bit, a user can use a two-piece driving tool which includes a stubby bit and an extension bit holder, which is economical to manufacture.

Referring to Taiwan Pat. No. M389617, a driving tool includes an assembly of a bit and a bit holder. Furthermore, the bit is made from a high hardness material, and the bit holder is made from material with less hardness than that of the bit. When the driving tool is rotated by a power tool and is subject to a large centrifugal force, the bit holder can distort, and the bit holder can disengage from the bit holder consequently.

The present invention is, therefore, intended to obviate or at least alleviate the problems encountered in the prior art.

SUMMARY OF THE INVENTION

According to the present invention, a driving tool includes a coupling component and a driving component coupled to the coupling component. The coupling component defines a first compartment and the driving component is received by the first compartment. The first compartment includes a first receiving section and a second receiving section. The driving component includes a first driving body portion, a second driving body portion, and a connecting portion. The second body driving section extends between the first driving body portion and the connecting portion. The connecting portion is inserted through the first receiving section and is fixedly disposed in the second receiving section. The connecting portion and the second receiving section are forced into a tight interference fit with each other such that the connecting portion and the second receiving section are unable to detach from each other. The second driving body portion includes a length inserted and disposed in the first receiving section. The first and second driving body portions are made to have a first hardness, and the connecting portion is made to have a second hardness different from the first hardness. The second hardness is less than the first hardness.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a driving tool including two pieces.

It is another objective of the present invention to provide a driving tool including a driving component and a coupling component firmly coupled to each other in a manner so that they don't disengage from each other once coupled together.

It is a further objective of the present invention that the driving component and the coupling component are coupled to each other without a securing member, in which the securing member includes an inner periphery abutting a periphery of one of the driving and coupling components and an outer periphery abutting a periphery of another of the driving and coupling components.

Other objectives, advantages, and new features of the present invention will become apparent from the following detailed description of the invention when considered in conjunction with the accompanied drawings.

DETAILED DESCRIPTION OF THE INVENTION

Figure 1:
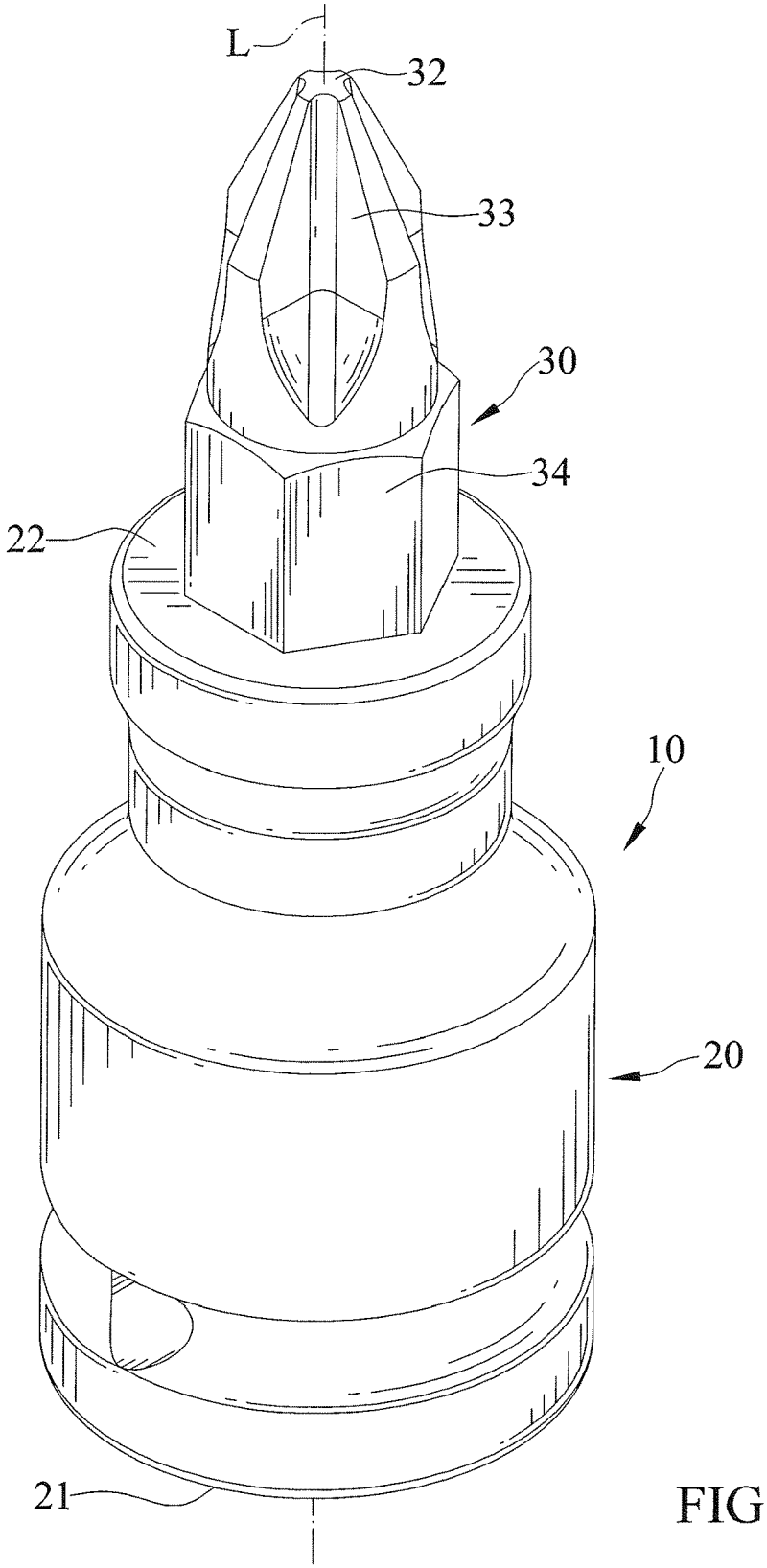
FIG. 1 is a perspective view of a driving tool in accordance with the present invention.
Figure 2:
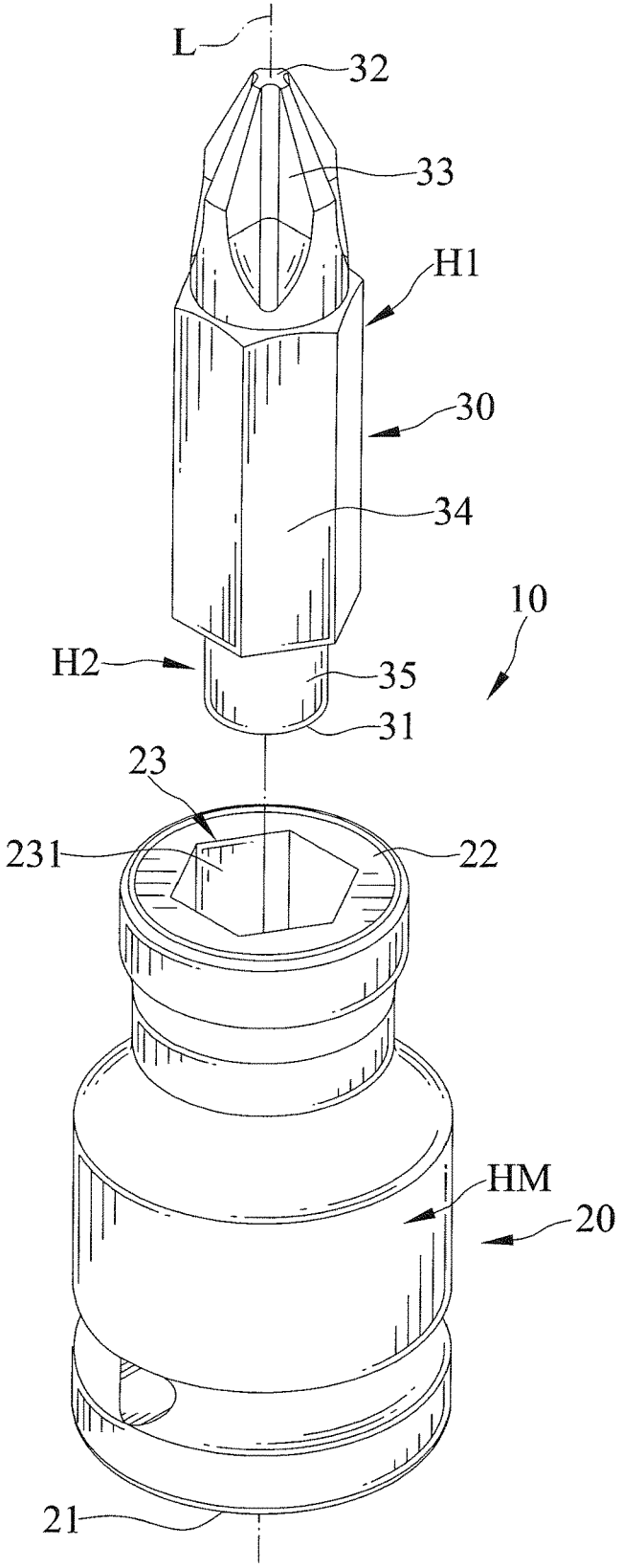
FIG. 2 is an exploded perspective view of the driving tool.
Figure 3:
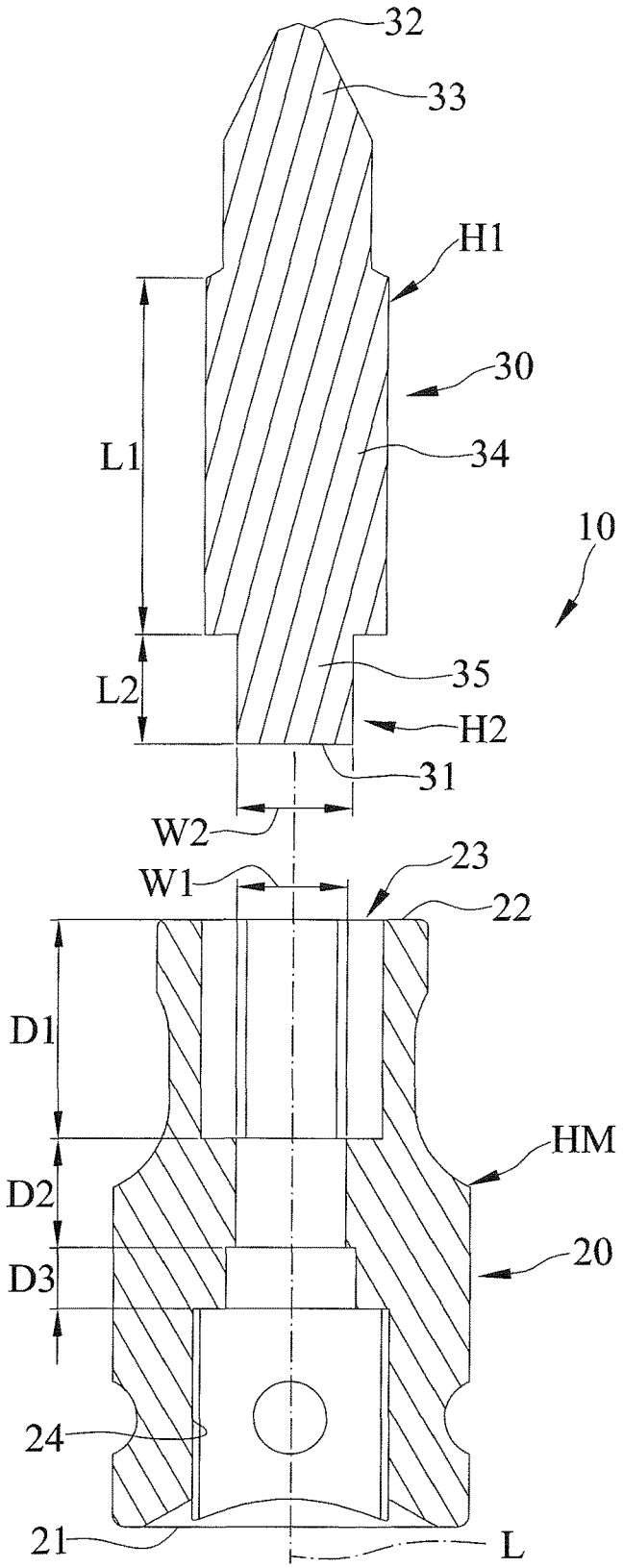
FIG. 3 is an exploded, cross-sectional view of the driving tool.
Figure 4:
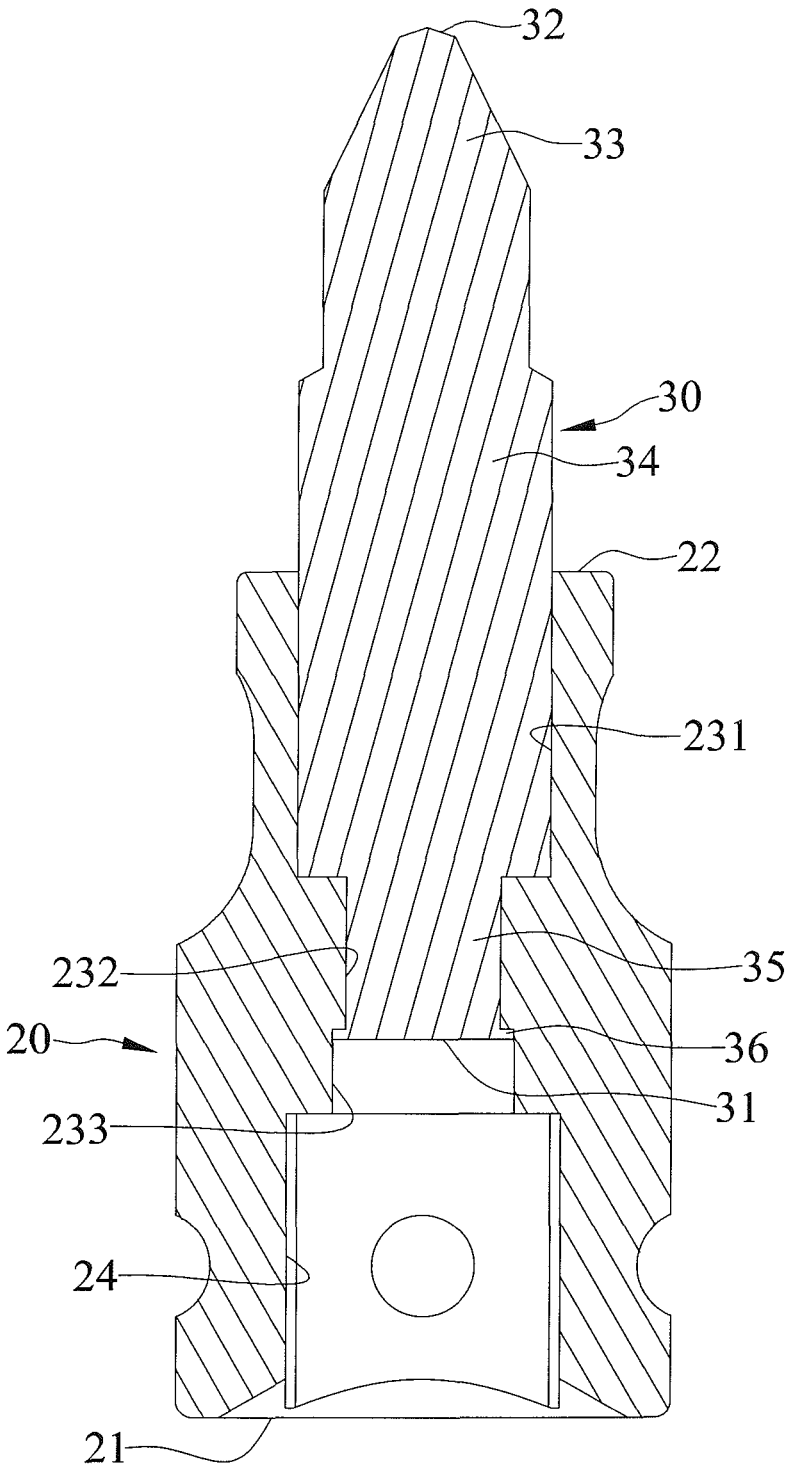
FIG. 4 is a cross-sectional view of the driving tool.

FIGS. 1 through 4 show a driving tool 10 in accordance with the present invention. The driving tool 10 includes a coupling component 20 and a driving component 30 coupled to the coupling component 20.

The coupling component 20 has a first end 21 and a second end 22 and extends longitudinally along an axis L from the first end 21 to the second end 22. The coupling component 20 defines a first compartment 23. The coupling component 20 defines a first compartment 23 at the second end 22. The coupling component 20 includes an inner wall delimiting the first compartment 23. The inner wall extends radially with respect to a center of the first compartment 23. The center of the first compartment 23 is disposed on the axis L. The first compartment 23 includes a first receiving section 231 and a second receiving section 232. The second receiving section 232 includes two opposite first lateral sides spaced at a first width W1. The first receiving section 231 includes two opposite lateral sides spaced at a minimum width greater than the first width W1. The first and second receiving sections 231 and 232 respectively have first and second depths D1 and D2 along the axis L.

The coupling component 20 defines a second compartment 233 extending from the second receiving section 232. The second receiving section 232 extends between the first receiving section 231 and the second compartment 233. The second compartment 233 includes two opposite third lateral sides spaced at a width greater than the first width W1.

The driving component 30 has a first end 31 and a second end 32 and extends longitudinally along the axis L from the first end 31 to the second end 32. The driving component 30 includes a first driving body portion 33, a second driving body portion 34, and a connecting portion 35. The second driving body portion 34 extends between the first driving body portion 33 and the connecting portion 35. The first and second driving body portions 33 and 34 are made to have a first hardness HI and the connecting portion 35 is made to have a second hardness H2 different from the first hardness Hl. The second hardness H2 is less than the first hardness Hl. The coupling component 20 has a body hardness HM and the first hardness H1 is greater than the body hardness HM. The second hardness H2 is less than the body hardness HM.

The driving component 30 is received by the first compartment 23. The connecting portion 35 is inserted through the first receiving section 231 and is fixedly disposed in the second receiving section 232. The connecting portion 35 and the second receiving section 232 are forced into a tight interference fit with each other such that the connecting portion 35 and the second receiving section 232 are unable to detach from each other. The second driving body portion 34 includes a length inserted and disposed in the first receiving section 231. The first driving body portion 33 is disposed outside the first compartment 23.

The second driving body portion 34 and the first receiving section 231 have conforming shapes. The second driving body portion 34 and the first receiving section 231 have conforming polygonal shapes. The connecting portion 35 and the second receiving section 232 have conforming shapes. The connecting portion 35 and the second receiving section 232 have conforming circular shapes.

The second driving body portion 34 and the connecting portion 35 respectively have first and second lengths L1 and L2 along the axis L. The second length L2 is smaller than the first length L1. The first length L1 is greater than the first depth D1. The second length L2 is greater than the second depth D2.

The connecting portion 35 includes two opposite second lateral sides correspondingly abutting the two first lateral sides and spaced at a second width W2. The second width W2 is greater than the first width W1. Therefore, the connection portion 35 is forced into the second receiving section 232.

The connecting portion 35 includes a length protruding in the second compartment 233. The length of connecting portion 35 is shaped to form a retaining structure 36 that has two opposite lateral sides spaced at a width greater than the first width and that abuts against an end wall of the second compartment 233. The second compartment 233 has a third depth D3 along the axis L. The third depth D3 is smaller than the second depth D2.

The coupling component 20 defines a slot 24 with which a driving tool is able to engage. The slot 24 has a polygonal shape in cross section.

In view of the forgoing, the driving component 30 is configured to couple to the coupling component 20 firmly and with less effort. The driving component 30 and the coupling component 20 can couple with each other in a manner that they don't disengage from each other, because the connecting portion 35 is in tight interference fit with the second receiving section 232. The driving component 30 and the coupling component 20 can couple with less effort, because the second hardness H2 is less than the first hardness H1, unlike conventional driving tools that has a uniform hardness.

Furthermore, it is inventive that the driving component 30 and the coupling component 20 are coupled to each other without a securing member. Generally, the securing member includes an inner periphery abutting a periphery of one of the driving and coupling components 30 and 20 and an outer periphery abutting a periphery of another of the driving and coupling components 30 and 20.

The foregoing is merely illustrative of the principles of this invention, and various modifications can be made by those skilled in the art without departing from the scope and spirit of the invention.

What is claimed is:

1. A driving tool comprising:

a coupling component;

a driving component formed as one piece from a single material and coupled to the coupling component;

wherein the coupling component defines a first compartment and the driving component is received by the first compartment, wherein the first compartment includes a first receiving section and a second receiving section, wherein the driving component includes a first driving body portion, a second driving body portion, and a connecting portion integrally formed together, wherein the second driving body portion extends between the first driving body portion and the connecting portion, wherein the connecting portion includes an outer periphery inserted through the first receiving section and contacting and fixedly disposed with a tight interference fit in the second receiving section, wherein the connecting portion and the second receiving section are forced into the tight interference fit with each other such that the connecting portion and the second receiving section are unable to detach from each other, wherein the coupling component defines a second compartment extending from the second receiving section, wherein the second driving body portion includes a length inserted and disposed in the first receiving section, wherein the connecting portion includes a length protruding in the second compartment, and wherein the length of the connecting portion is shaped to form a retaining structure that has two opposite lateral sides spaced at a width greater than the first width and that abuts against an end wall of the second compartment, wherein the second compartment extends towards the slot past the retaining structures, wherein the first and second driving body portions are made to have a first hardness and the connecting portion is made to have a second a second hardness different from the first hardness, and wherein the second hardness is less than the first hardness.

2. The driving tool as claimed in claim 1, wherein the second receiving section includes two opposite first lateral sides spaced at a first width, wherein the connecting portion includes two opposite second lateral sides correspondingly abutting the two first lateral sides and spaced at a second width, and wherein the second width is greater than the first width.

3. The driving tool as claimed in claim 2, wherein the second receiving section extends between the first receiving section and the second compartment, and wherein the second compartment includes two opposite third lateral sides spaced at a width greater than the first width.

4. The driving tool as claimed in claim 3, wherein the driving component has a first end and a second end and extends longitudinally along an axis from the first end to the second end, wherein the second driving body portion and the connecting portion respectively have first and second lengths along the axis, and wherein the second length is smaller than the first length.

5. The driving tool as claimed in claim 4, wherein the coupling component has a first end and a second end and extends longitudinally along the axis from the first end to the second end, wherein the first and second receiving sections respectively have first and second depths along the axis, wherein the first length is greater than the first depth, and wherein the second length is greater than the second depth.

6. The driving tool as claimed in claim 5, wherein the second compartment has a third depth along the axis, and wherein the third depth is smaller than the second depth.

7. The driving tool as claimed in claim 2, wherein the first receiving section includes two opposite lateral sides spaced at a minimum width greater than the first width.

8. The driving tool as claimed in claim 1, wherein the coupling component has a body hardness, wherein the first hardness is greater than the body hardness, and wherein the second hardness is less than the body hardness.

9. The driving tool as claimed in claim 1, wherein the second driving body portion and the first receiving section have conforming shapes, wherein the second driving body portion and the first receiving section have conforming polygonal shapes, wherein the connecting portion and the second receiving section have conforming shapes, and wherein the connecting portion and the second receiving section have conforming circular shapes.

10. The driving tool as claimed in claim 1, wherein the coupling component defines a slot adapted to be engaged by a driving tool, and wherein the slot has a polygonal shape in cross section.

11. The driving tool as claimed in claim 1, wherein the first driving body portion is disposed outside the first compartment.

* * * * *